US010371111B2

(12) United States Patent
Schnedt

(10) Patent No.: US 10,371,111 B2
(45) Date of Patent: Aug. 6, 2019

(54) DEVICE FOR INJECTING FUEL INTO THE COMBUSTION CHAMBER OF AN INTERNAL COMBUSTION ENGINE

(71) Applicant: Robert Bosch GmbH, Stuttgart (DE)

(72) Inventor: Johannes Schnedt, Koppl (AT)

(73) Assignee: Robert Bosch GmbH, Stuttgart (DE)

( * ) Notice: Subject to any disclaimer, the term of this patent is extended or adjusted under 35 U.S.C. 154(b) by 507 days.

(21) Appl. No.: 14/371,037

(22) PCT Filed: Jan. 17, 2013

(86) PCT No.: PCT/IB2013/000212
§ 371 (c)(1),
(2) Date: Jul. 8, 2014

(87) PCT Pub. No.: WO2013/111008
PCT Pub. Date: Aug. 1, 2013

(65) Prior Publication Data

US 2014/0345569 A1 Nov. 27, 2014

(30) Foreign Application Priority Data

Jan. 26, 2012 (AT) ..... A105/2012

(51) Int. Cl.
*F02M 47/02* (2006.01)
*F02M 69/04* (2006.01)

(52) U.S. Cl.
CPC ..... *F02M 69/04* (2013.01); *F02M 47/027* (2013.01); *F02M 2200/40* (2013.01)

(58) Field of Classification Search
CPC ..... F02M 2200/40; F02M 2200/28; F02M 2200/315; F02M 55/04; F02M 41/16; F02M 47/02; F02M 59/022; F02M 63/0003

(Continued)

(56) References Cited

U.S. PATENT DOCUMENTS 3,187,733 A * 6/1965 Heintz ..... F02M 47/02 123/447
4,662,315 A * 5/1987 Sommer ..... F02M 47/02 123/23

(Continued)

FOREIGN PATENT DOCUMENTS

AT 509 877 A4 12/2011
DE 10 2006 027 614 A1 12/2007

(Continued)

OTHER PUBLICATIONS

International Search Report corresponding to PCT Application No. PCT/IB2013/000212, dated May 15, 2013 (German and English language document) (7 pages).

*Primary Examiner* — Jacob M Amick
*Assistant Examiner* — Michael A Kessler
(74) *Attorney, Agent, or Firm* — Maginot, Moore & Beck LLP

(57) ABSTRACT

A device for injecting fuel into the combustion chamber of an internal combustion engine comprising at least one injector. The injector includes an injector body, a high-pressure accumulator integrated into the injector body, an injection nozzle, a high-pressure bore, and a feed bore. The injection nozzle defines a nozzle chamber and has a nozzle needle configured to be guided in an axially movable manner and that is surrounded by the nozzle chamber. The high-pressure bore is connected to the high-pressure accumulator and the nozzle chamber. The feed bore is configured to feed high-pressure fuel to the high-pressure accumulator. Additionally, the feed bore has a lance connection positioned laterally on the injector body, is formed as a bore separate from the high-pressure bore, and connects the lance connection directly to the high-pressure accumulator.

8 Claims, 2 Drawing Sheets

(58) Field of Classification Search
USPC ..... 239/533.5, 533.2; 123/445
See application file for complete search history.

(56) References Cited

U.S. PATENT DOCUMENTS

| | | | | | |
|---|---|---|---|---|---|
| 5,012,786 | A * | 5/1991 | Voss | F02M 47/02 | 123/447 |
| 2004/0187848 | A1* | 9/2004 | Hlousek | F02M 47/027 | 123/447 |
| 2008/0296413 | A1* | 12/2008 | Ganser | F02M 47/027 | 239/533.4 |
| 2010/0263626 | A1* | 10/2010 | Kammerstetter | F02M 47/027 | 123/337 |

FOREIGN PATENT DOCUMENTS

| | | | | | |
|---|---|---|---|---|---|
| EP | 1 612 405 | A1 | | 1/2006 | |
| JP | 2000-205081 | A | | 7/2000 | |
| JP | 2000205081 | A | * | 7/2000 | F02M 55/02 |
| WO | 03/076794 | A1 | | 9/2003 | |
| WO | 2007/143768 | A1 | | 12/2007 | |

* cited by examiner

DEVICE FOR INJECTING FUEL INTO THE COMBUSTION CHAMBER OF AN INTERNAL COMBUSTION ENGINE

This application is a 35 U.S.C. § 371 National Stage Application of PCT/IB2013/000212, filed on Jan. 17, 2013, which claims the benefit of priority to Ser. No. A 105/2012, filed on Jan. 26, 2012 in Austria, the disclosures of which are incorporated herein by reference in their entirety.

BACKGROUND

The disclosure relates to a device for injecting fuel into the combustion chamber of an internal combustion engine, having at least one injector, which has a high-pressure accumulator integrated into the injector body, an injection nozzle that has a nozzle needle which is guided in an axially movable manner and which is surrounded by a nozzle chamber, a high-pressure bore connecting the high-pressure accumulator and the nozzle chamber, and a feed bore for feeding high-pressure fuel to the high-pressure accumulator, wherein the feed bore has a lance connection arranged laterally on the injector body.

Injectors of this kind are used in modular common rail systems, which are characterized in that some of the reservoir volume present in the system is present in the injector itself. Modular common rail systems are used on particularly large engines, on which the individual injectors may under certain circumstances be fitted at considerable spacings. On such engines, using just a single rail for all the injectors is not expedient since there would be a massive dip in the injection pressure during injection owing to the long lines, with the result that there would be a significant drop in the injection rate in the case of a relatively long injection duration. On such engines, provision is therefore made to arrange a high-pressure accumulator within each injector. Such a design is referred to as a modular construction since each individual injector has a dedicated high-pressure accumulator and can thus be used as a self-contained module. Here, a high-pressure accumulator is not intended to mean a conventional line but is a pressure resistant vessel having an inlet and an outlet line, the diameter of which is significantly enlarged as compared with the high-pressure lines to enable a certain injection quantity to be dispensed from the high-pressure accumulator without an immediate pressure drop.

Injectors of modular common rail systems are fed with high-pressure fuel from a high-pressure pump, wherein the feed is accomplished either via a high-pressure connection of the injector on the top side of the high-pressure accumulator ("top feed") or via a lance which makes lateral contact with the injector ("side feed"). In the case of the side feed, the lance opens via a lance connection of the injector into a feed bore, which opens into the high-pressure bore connecting the high-pressure accumulator to the nozzle pre-chamber. Fundamentally, the side feed has a number of advantages, especially in the case of large engines, since it allows the path of the fuel to the injector to be routed transversely through the cylinder, thereby generally making it possible to shorten the length of the feed as compared with a top feed. However, the conventional type of side feed is associated with the disadvantage that the high-pressure fuel flows directly from the lance connection to the injection nozzle during injection, leading to inadequate exchange of fuel in the high-pressure accumulator. However, exchange of the fuel is important to prevent deposits or the formation of residues. There is a risk of deposits or residues particularly with the use of high viscosity fuels, e.g. heavy oil in large diesel engines. Another disadvantage of the design described above involving side feed is that the outlet location of the feed bore into the high-pressure bore, which is usually embodied in the form of a T joint, is disadvantageous in terms of strength.

SUMMARY

The disclosure therefore aims to avoid the abovementioned disadvantages, especially the formation of deposits and residues in the high-pressure accumulator of a modular common rail injector.

To achieve this object, starting from a device of the type stated at the outset, the disclosure essentially envisages that the feed bore is designed as a bore which is separate from the high-pressure bore and connects the lance connection directly to the high-pressure accumulator. This ensures that the entire quantity of fuel fed to the injector is passed through the high-pressure accumulator, thus enabling sufficient exchange of the fuel in the high-pressure accumulator to take place. This routing of the fuel furthermore promotes the formation of turbulence, thereby ensuring better removal of air from the high-pressure accumulator.

A particularly preferred design envisages that the lance connection is formed on a holding body, which is connected, in particular screwed, at the end to the accumulator tube forming the high-pressure accumulator.

In a common rail system, electronically controlled injectors are used to inject fuel into the combustion chamber of the engine. The servo valves used in said injectors bring about very rapid closure of the injection nozzle. During the closure of the injection nozzle, the fuel runs against a closed end of the line and, owing to the inertia of the fuel, the pressure ahead of the injection nozzle rises significantly. This pressure peak consequently travels backward and forward in the high-pressure bore between the injection nozzle and the high-pressure accumulator, giving rise to powerful pressure pulsations at the nozzle seat and leading to severe wear here. In unfavorable cases, the pressure peaks which occur in this process are up to 500 bar above the rail pressure.

In the case of a rapid succession of injection processes, these pressure oscillations furthermore lead to severe fluctuations in the injection rate. If, for example, a pressure oscillation is induced at the nozzle seat by a pilot injection, the quantity injected in the second, subsequent injection with a constant opening time of the nozzle needle depends on whether the second injection has taken place more at a maximum or at a minimum of the pressure oscillations. As little pressure oscillation as possible at the injection nozzle in all operating states of the hydraulic system is therefore desirable.

One possibility for reducing pressure pulsations can be found in WO 2007/143768 A1, wherein a resonator line arranged in parallel with the high-pressure line between the injection nozzle and the high-pressure accumulator is provided, said resonator line having a resonator restrictor on the high-pressure accumulator side. The resonator restrictor is preferably arranged at the inlet of the resonator line leading into the high-pressure accumulator. The design known from WO 2007/143768 A1 thus envisages that the high-pressure line should be divided into two mutually independent regions, one of which is fitted with a restrictor, ensuring that the pressure oscillations which arise at the nozzle seat are reflected differently in the two regions and the reflected oscillations almost cancel each other out by virtue of their phase difference. This manner of reducing pressure pulses does not work in an optimum manner with a conventional fuel feed by means of side feed since, in this case, the lateral fuel feed opens into the high-pressure bore, and reflections and superpositions of pressure waves occur at the entry point, interfering with the extinction of pressure waves intended with the resonator system described. With the design according to the disclosure, in which the fuel is fed directly into the high-pressure accumulator from the lance connection, the interfering effect of the entry point is eliminated, allowing the resonator system to reduce the pressure pulses in a considerably more effective manner.

The design according to the disclosure plays a particularly advantageous role in injectors in which, in order to control the opening and closing movement of the nozzle needle, said needle can be acted upon in an axial direction by the pressure prevailing in a control space that can be fed with fuel under pressure, wherein the control space is connected to a feed channel having a feed restrictor and to a drain channel having a drain restrictor, and at least one control valve that opens or closes the feed or drain channel is provided, by means of which the pressure in the control space can be controlled.

BRIEF DESCRIPTION OF THE DRAWINGS

The disclosure is explained in greater detail below by means of an illustrative embodiment shown schematically in the drawings. In said drawings.

DETAILED DESCRIPTION

Figure 1:
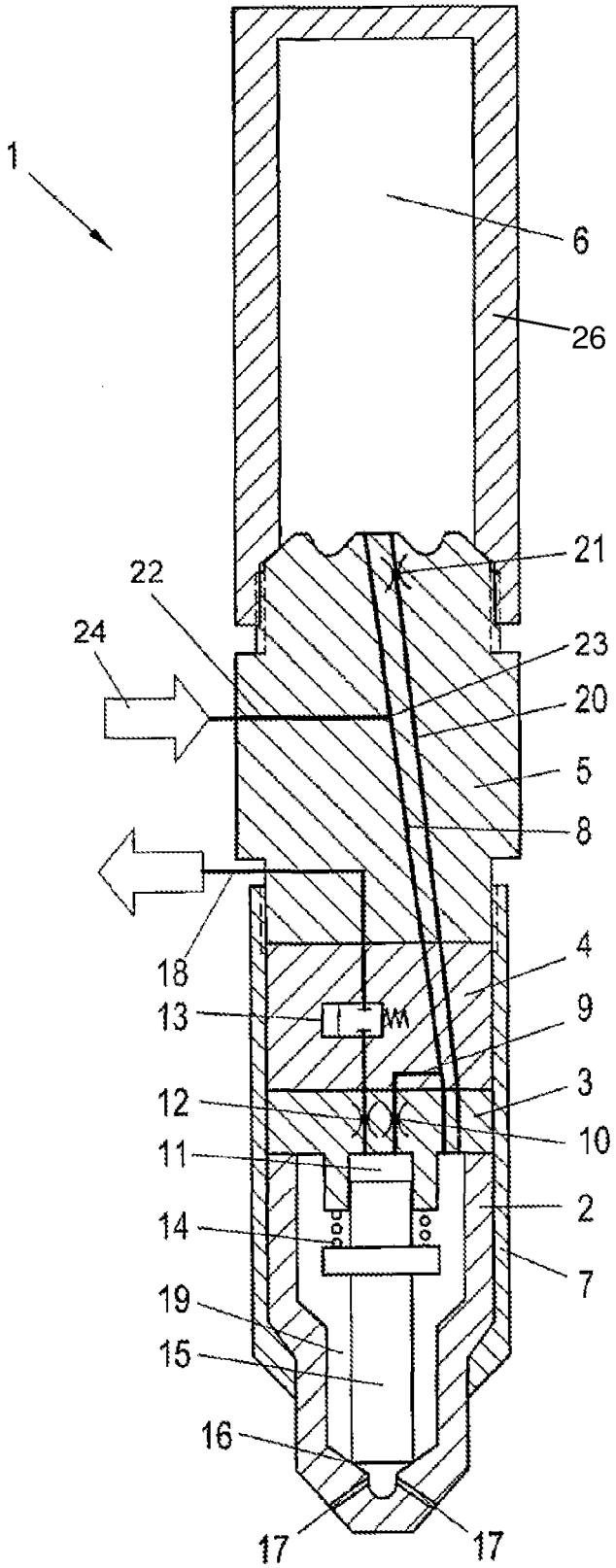
Fig. 1 Prior Art
FIG. 1 shows schematically a cross-section of a prior art injector fitted with a high-pressure accumulator.

FIG. 1 shows an injector 1, which has an injection nozzle 2, a restrictor plate 3, a valve plate 4, a holding body 5 and a high-pressure accumulator 6 formed by an accumulator tube 26, wherein a nozzle clamping nut 7 screwed to the holding body 5 holds together the injection nozzle 2, the restrictor plate 3 and the valve plate 4. In the state of rest, the solenoid valve 13 is closed, with the result that the high-pressure fuel from the high-pressure accumulator 6 flows into the control space 11 of the injection nozzle 2 via the high-pressure line 8, the cross connection 9 and the feed restrictor 10, but outflow from the control space 11 via the drain restrictor 12 is blocked at the valve seat of the solenoid valve 13. The system pressure prevailing in the control space 11, together with the force of the nozzle spring 14, presses the nozzle needle 15 into the nozzle needle seat 16, with the result that the spray holes 17 are closed. If the solenoid valve 13 is actuated, it allows flow via the solenoid valve seat, and fuel flows out of the control space 11, through the drain restrictor 12, the solenoid valve armature space and the low-pressure bore 18 back into the fuel tank (not shown). A pressure equilibrium defined by the flow cross sections of the feed restrictor 10 and the drain restrictor 12 is established in the control space 11, this being so small that the system pressure prevailing in the nozzle space 19 is able to open the nozzle needle 15 guided in a longitudinally movable manner in the nozzle body, with the result that the spray holes 17 are exposed and an injection takes place.

As soon as the solenoid valve 13 is closed, the drain path of the fuel through the drain restrictor 12 is blocked. Fuel pressure is built up again in the control space 11 via the feed restrictor 10, generating an additional closing force which reduces the hydraulic force on the pressure shoulder of the nozzle needle 15 and exceeds the force of the nozzle spring 14. The nozzle needle 15 closes the path to the injection openings 17, and the injection process is ended.

Owing to the inertia of the fuel in the accumulator 6, the high-pressure line 8 and the nozzle space 19, there are severe pressure oscillations that the nozzle seat 16 directly after the closure of the nozzle needle 15 since the flowing fuel has to be slowed down in a very short time. To reduce the pressure oscillations, use is made of a resonator. This consists of a resonator line 20, which has the same length and the same diameter as the high-pressure line 8, and of a resonator restrictor 21, which is fitted at the accumulator end of the resonator line 20 and connects said line to the accumulator 6. When the solenoid valve 13 is closed, the pressure pulse which arises at the nozzle seat 16 propagates via the nozzle space 19 into the high-pressure line 8 and the resonator line 20. At the end of the high-pressure line 8, the pressure pulse is reflected at the open end at the transition to the accumulator 6. At the same time, the pressure pulse traveling in the resonator line 20 is reflected at the resonator restrictor 21 at the closed end. Owing to the different type of reflection (open or closed end), there is a phase difference of 180° between the two reflected pressure pulses, with the result that they cancel each other out when they meet in the nozzle space 19. As a result, there are no further pressure pulses at the nozzle seat 16, and therefore significantly less wear occurs here.

In the prior art embodiment shown in FIG. 1, the high-pressure fuel is fed to the high-pressure accumulator 6 from the side of the injector 1, namely via a side feed 24. The side feed 24 comprises a lance screwed laterally into the injector 1 or a lance connection 25 (shown only in FIG. 2). The feed bore is denoted by 22 and opens into the high-pressure bore 8 at 23. Thus, during the injection by the injector 1 the fuel does not flow only from the high-pressure accumulator 6 to the injection nozzle 2 but, owing to the pressure drop, also flows directly from the feed bore 22 to the injection nozzle 2. On completion of the injection, the high-pressure accumulator 6 is refilled by the additional fuel flowing from the lance. As a result, there is only a slight fuel exchange in the accumulator by means of this additional quantity.

Figure 2:
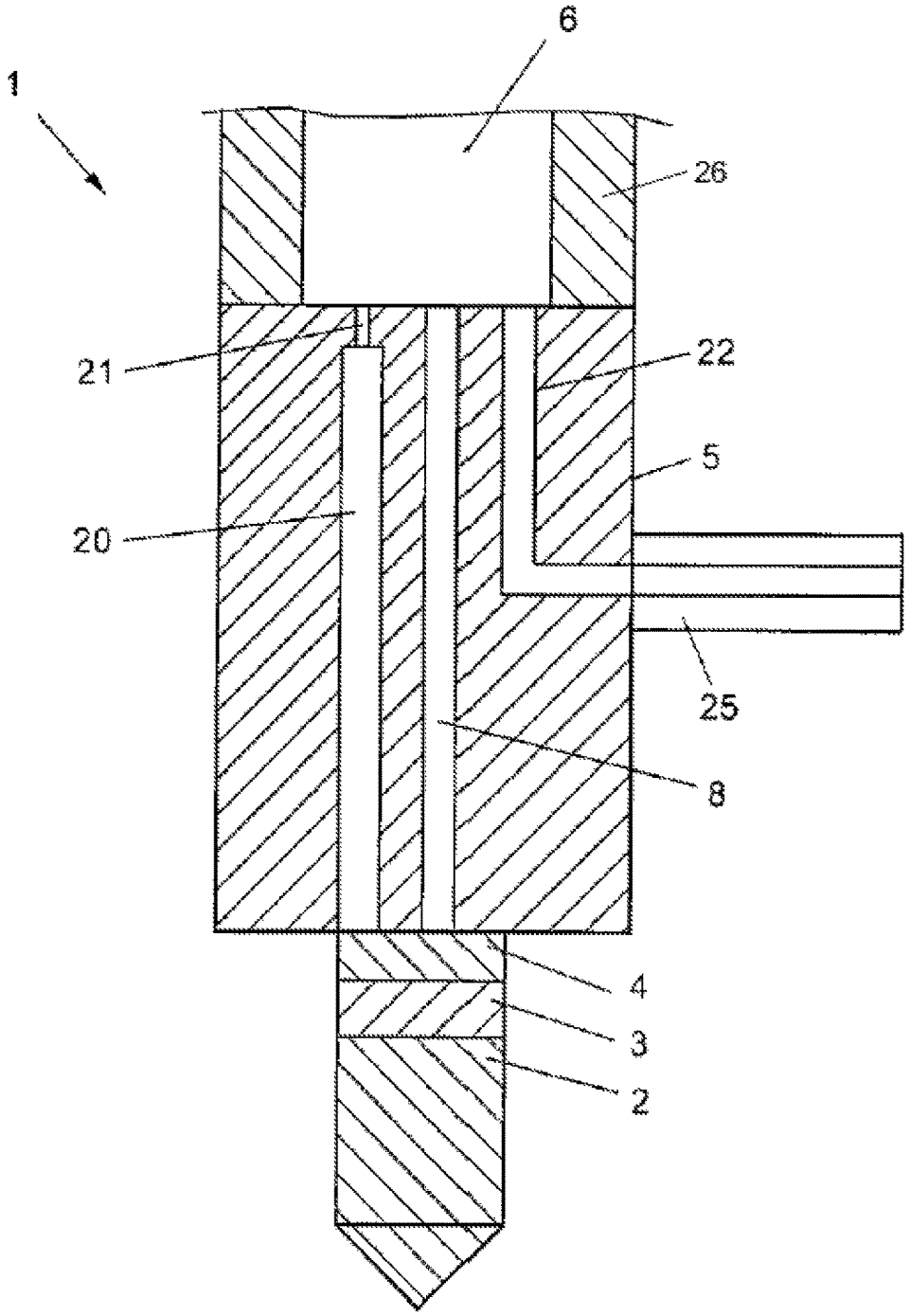
FIG. 2 shows a schematic illustration of the injector design according to the disclosure

FIG. 2 shows a highly schematized illustration of the injector 1, wherein the functional components described in detail in FIG. 1, namely the accumulator 6, the holding body 5, the valve plate 4, the restrictor plate 3 and the injection nozzle 2 are merely outlined without a detailed illustration of their individual components, as described by means of FIG. 1. FIG. 2 shows the design according to the disclosure, in which the feed bore 22 connects the lance connection 25 directly to the high-pressure accumulator 6. This has the effect that the entire injection quantity is taken from the high-pressure accumulator 6 in each injection, with the result that there is sufficient circulation of the accumulator contents over the time in operation.

The invention claimed is:

1. A device for injecting fuel into the combustion chamber of an internal combustion engine, comprising:

at least one injector including:

an injector body including an accumulator tube, a holding body, and an injection nozzle, the holding body having a first end connected to the accumulator tube, the accumulator tube defining a high-pressure accumulator chamber integrated into the injector body, and the injection nozzle defining a nozzle chamber and having a nozzle needle surrounded by the nozzle chamber and configured to be guided in an axially movable manner;

a high-pressure bore defined at least partially in the holding body and connecting the high-pressure accumulator chamber and the nozzle chamber;

a feed bore defined at least partially in the holding body and configured to feed high-pressure fuel to the high-pressure accumulator chamber; and a lance connection positioned laterally on the holding body of the injector body, wherein the feed bore is formed separately from the high-pressure bore, and connects the lance connection directly to a portion of the high-pressure accumulator chamber defined in the accumulator tube.

2. The device for injecting fuel into the combustion chamber of an internal combustion engine as claimed in claim 1, further comprising:

a resonator bore positioned in parallel with the high-pressure bore and connected to the injection nozzle, wherein the resonator bore is configured to open into the high-pressure accumulator chamber via a resonator restrictor.

3. The device for injecting fuel into the combustion chamber of an internal combustion engine as claimed in claim 1, wherein:

the nozzle needle is configured to be opened and closed by being acted upon in an axial direction by a pressure prevailing in a control space that is fed with fuel under pressure;

the control space is connected to a feed channel having a feed restrictor and to a drain channel having a drain restrictor; and at least one control valve is configured to control the pressure in the control space by opening or closing the feed channel or drain channel.

4. The device for injecting fuel into the combustion chamber of an internal combustion engine as claimed in claim 1, wherein the holding body is connected to the accumulator tube by being screwed at the first end to the accumulator tube.

5. The device for injecting fuel into the combustion chamber of an internal combustion engine as claimed in claim 1, wherein the holding body is interposed axially between the high-pressure accumulator chamber and the injection nozzle.

6. The device for injecting fuel into the combustion chamber of an internal combustion engine as claimed in claim 1, wherein the feed bore and the high-pressure bore both open into the high-pressure accumulator chamber at the first end of the holding body.

7. The device for injecting fuel into the combustion chamber of an internal combustion engine as claimed in claim 1, wherein the feed bore includes a first portion extending parallel to the high-pressure bore and opening into the high-pressure accumulator chamber, and a second portion extending laterally from the first portion to the lance connection.

8. The device for injecting fuel into the combustion chamber of an internal combustion engine as claimed in claim 7, wherein the first portion and the second portion are both defined in the holding body.

* * * * *